US005819554A

United States Patent [19]

Glen

[11] Patent Number: 5,819,554

[45] Date of Patent: Oct. 13, 1998

[54] ROTATING VANE COMPRESSOR WITH ENERGY RECOVERY SECTION, OPERATING ON A CYCLE APPROXIMATING THE IDEAL REVERSED CARNOT CYCLE

[75] Inventor: John Stewart Glen, Deep River, Canada

[73] Assignee: Refrigeration Development Company, Deep River, Canada

[21] Appl. No.: 454,823

[22] Filed: May 31, 1995

[51] Int. Cl.[6] ..... F25B 1/00; F01C 11/00

[52] U.S. Cl. ..... 62/498; 62/116; 418/212

[58] Field of Search ..... 62/116, 527, 498, 62/402; 418/212; 417/406; 60/671

[56] References Cited

U.S. PATENT DOCUMENTS

| | | | |
|---|---|---|---|
| 2,208,177 | 9/1940 | Barrett | 418/212 X |
| 2,576,663 | 11/1951 | Atchison | 62/116 X |
| 4,235,079 | 11/1980 | Masser | 62/402 X |
| 5,347,823 | 9/1994 | Alsenz | 62/116 |
| 5,467,613 | 11/1995 | Brasz | 62/402 |

FOREIGN PATENT DOCUMENTS

| | | | |
|---|---|---|---|
| 0121405 | 9/1979 | Japan | 418/212 |

OTHER PUBLICATIONS

Fundamentals of Classical Thermodynamics, Van Wyen & Sonntag John Wiley & Sons, 1985 pp. 163–165.

*Primary Examiner*—William E. Wayner

[57] ABSTRACT

A rotating vane machine is described in which compression and energy recovery expansion is obtained within one compact design. The machine is operated in conjunction with a new thermodynamic cycle which approaches the ideal reversed Carnot cycle to optimize efficiency. The new cycle simplifies control, and enables the rotating machinery to be of simple construction.

11 Claims, 3 Drawing Sheets

ROTATING VANE COMPRESSOR WITH ENERGY RECOVERY SECTION, OPERATING ON A CYCLE APPROXIMATING THE IDEAL REVERSED CARNOT CYCLE

FIELD OF INVENTION

This invention is related to rotary sliding vane compressors in which energy recovery via an integral expander is employed, and operation in a cycle approaching the ideal reversed Carnot cycle is used.

BACKGROUND

Refrigeration, air-conditioning, and heat pump systems are currently used extensively. Continual improvements are being introduced to improve efficiency or coefficient of performance, yet such systems are currently only half as efficient as they could be. It is the objective of this invention to significantly improve overall efficiency by development of an improved rotating-vane compressor with energy recovery expander section, which can operate on a new cycle more closely approximating the ideal reversed Carnot cycle, yet still satisfy marketplace requirements of simplicity, low cost, long life, and low noise etc. The concept will now be outlined in more detail.

SUMMARY OF THE INVENTION

FIG. 1 illustrates the reversed Rankine cycle ABCD that current refrigeration systems operate under, while WXYZV shows the new cycle of this patent. FIG. 4 shows the corresponding system components. Conventional compression AB takes place in the superheat field to ensure no moisture is present. This is wasteful, and since rotating vane compressors can handle wet vapor, the new cycle of this patent is based on compression from close to point W to point X. The reduced energy needed to operate, from W to X compared to AB is evident in FIG. 1 from the relative slopes of the isentropic curves.

Conventional systems recover no energy as the pressurized liquid returning from the condenser BC is expanded in a control valve CD. Expanding along YV via an expander recovers compression energy, but the volume ratios required in the machinery of 30 to 70 are excessive for most internal geometry. It however, expansion first occurs through a control valve YZ, followed by a rotary vane expander ZV, then an expansion ratio of about 5 is all that is required for ZV, and this can readily be achieved even using the simplest circular geometry. The energy not recovered between Y and Z is not so significant as shown by comparing the relative slopes of the isentropic curves at YZ and ZV. This is a key observation which enables circular geometry and control strategy comparable to conventional systems to be employed. What is needed to exploit this more efficient cycle is practical low cost machinery.

The embodiment of a machine needed to approach the perfect reversed Carnot thermodynamic cycle will therefor consist of a compressor section and expander section, both capable of handling two-phase flow. At the same time each section must be of simple design to keep construction costs competitive, and have minimal parasitic losses due to friction, leakage, and unwanted heat transfer.

Rotating vane compressors are one class of practical machinery which exhibit very efficient operation, have operated successfully in certain two-phase environments, and appear capable of further efficiency improvements. Low noise, low pressure pulsations, and long life are other features of rotating vane machines. Consequently the rotating vane machine is the basis of this patent, although other machinery could use the improved operating cycle.

Compression ratio needed in a compressor is a function of the refrigerant fluid and operating temperatures in the evaporator and condenser, which vary with ambient conditions. Consequently reed valve control of discharge from the compressor section is indicated for efficiency, minimizing over-compression losses.

Achieving the necessary compression and expansion ratios of the rotating machinery is influenced by internal geometry, and number of vanes. Circular geometry, with a single axis offset is chosen for the reference compressor/expander due to ease of manufacture. More complex geometry based on smooth curved shapes is also possible.

From study FIG. 1 it is apparent that the fluid density at the compressor inlet VI is about ⅓ that at the expander outlet V, consequently the ratio of lengths of the compressor rotor to the expander rotor can be used as a simple means to approximate the desired compression and expansion ratios.

Typically 5 or 6 vanes will be used in the compressor and expander sections. While only 1 vane is possible in the compressor, pressure pulsation reduction indicates more vanes are desirable. In the expander a large number of vanes is desirable, but a practical limit is imposed by space and strength considerations in small machinery. Viability is achieved for a circular geometry expander with about 5 or 6 vanes, and an expansion control valve before the expander ,as discussed earlier.

Vane tip geometry, and vane motion control, are other aspects to be defined. Circular tip geometry is selected for the reference design due to ease of manufacture and compatibility with a circular casing. Vane width is chosen to ensure adequate vane stiffness, and to ensure smooth contact throughout rotation.

Vane motion control to minimize leakage between tip and casing can best be achieved by internal fluid (oil &/or refrigerant) supplementing centrifugal forces and hence limiting vane bounce as is conventionally done. At the same time, it is necessary to ensure adequate lubrication of the vane tip to promote hydroplaning and thus minimize friction and wear.

DETAILED DESCRIPTION

Figure 1:
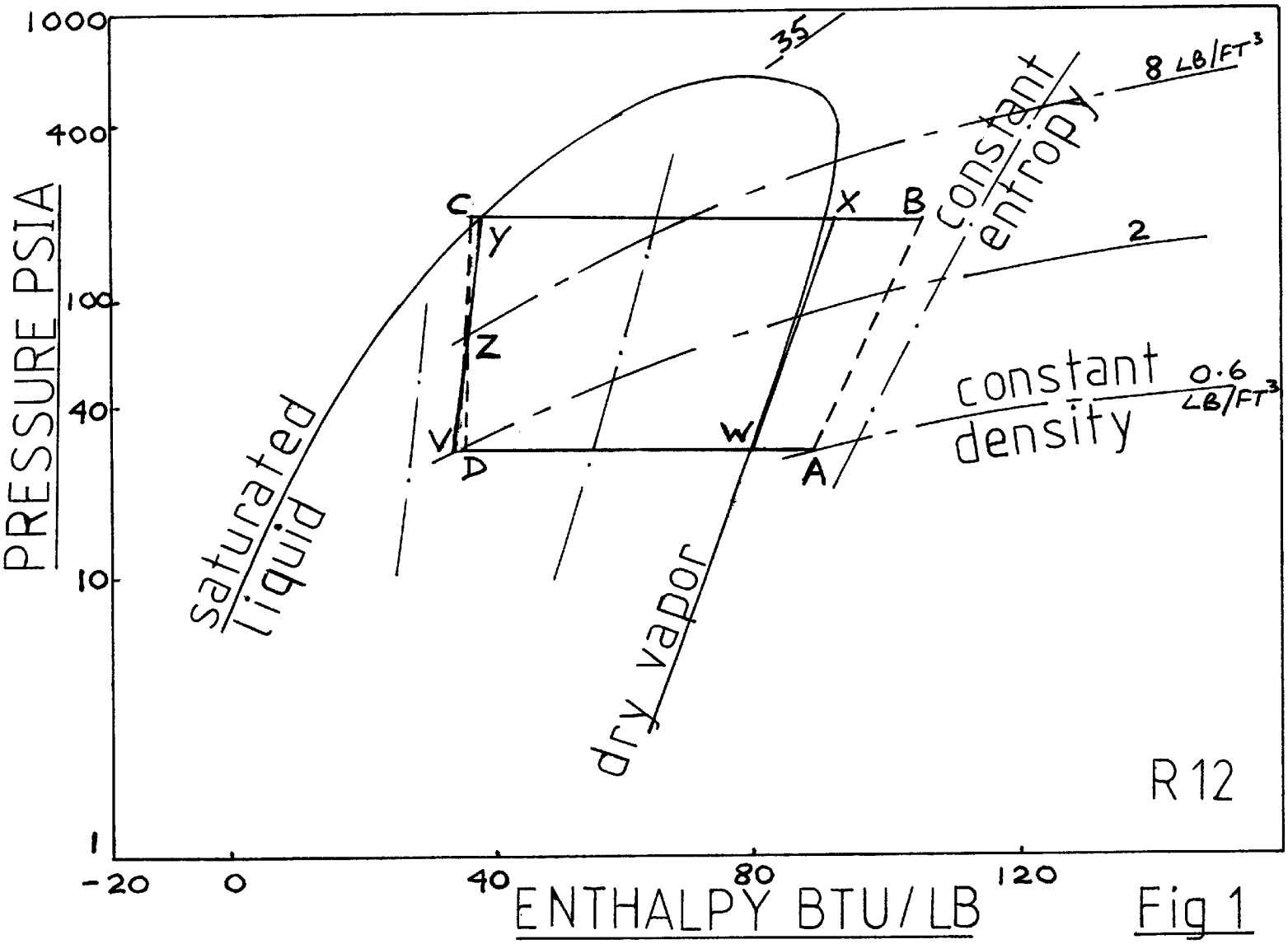
FIG. 1 is a pressure enthalpy graph for a typical refrigerant. Superimposed on FIG. 1 are the ideal Rankine thermodynamic cycle ABCD, and the improved cycle WXYZV of this patent.
Figure 4:
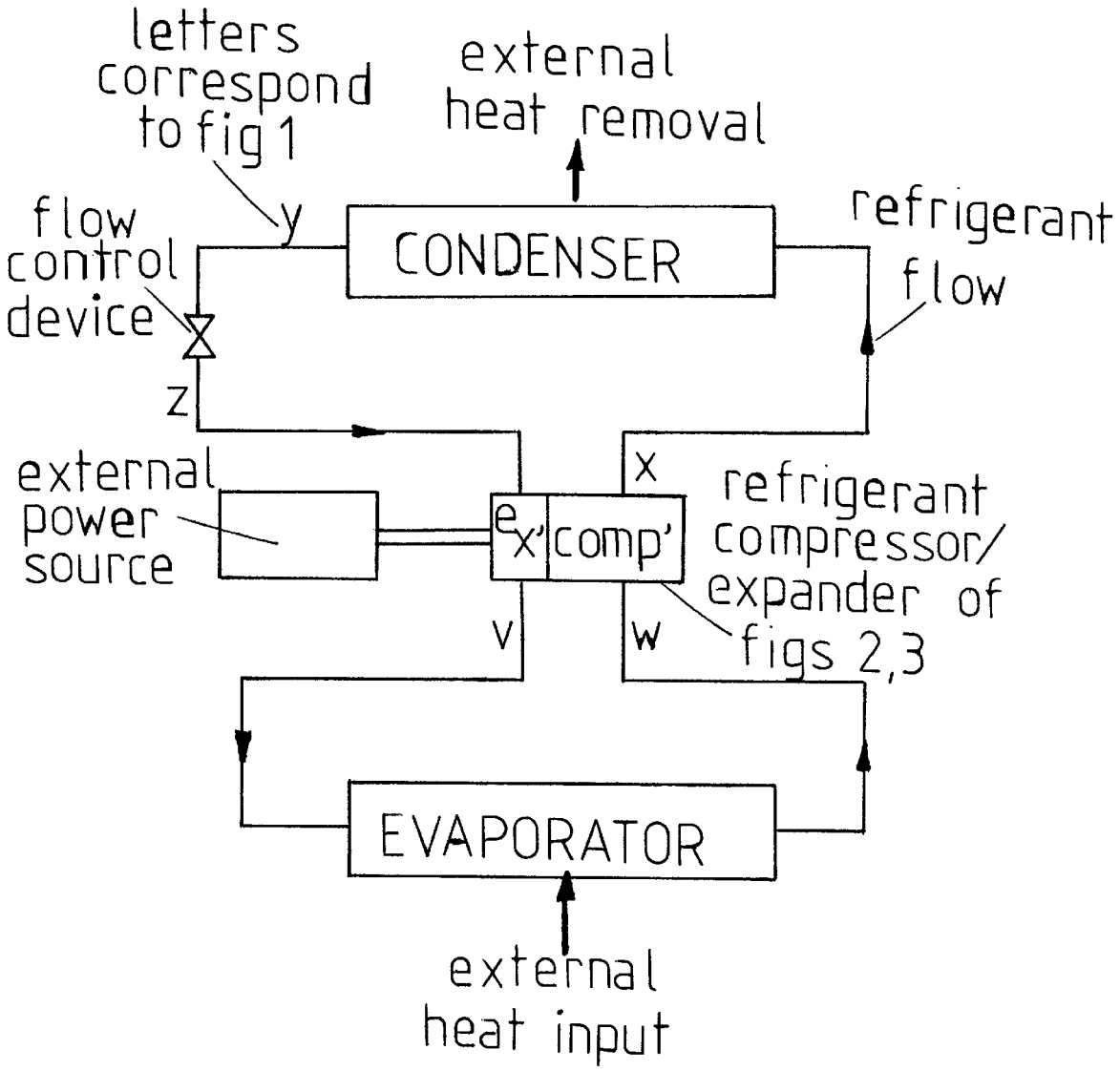
FIG. 4 indicates the main components of the system, corresponding to the cycle WXYZV of FIG. 1.

FIG. 1 indicates the operating conditions ( isenthalpic conditions are indicated for simplicity) of the compressor Wx and expander ZV, and provides the thermodynamic inlet and outlet volumes required of the rotating machinery. FIG. 4 indicates the corresponding components of the system, including conventional external power input to the compressor.

Figure 2:
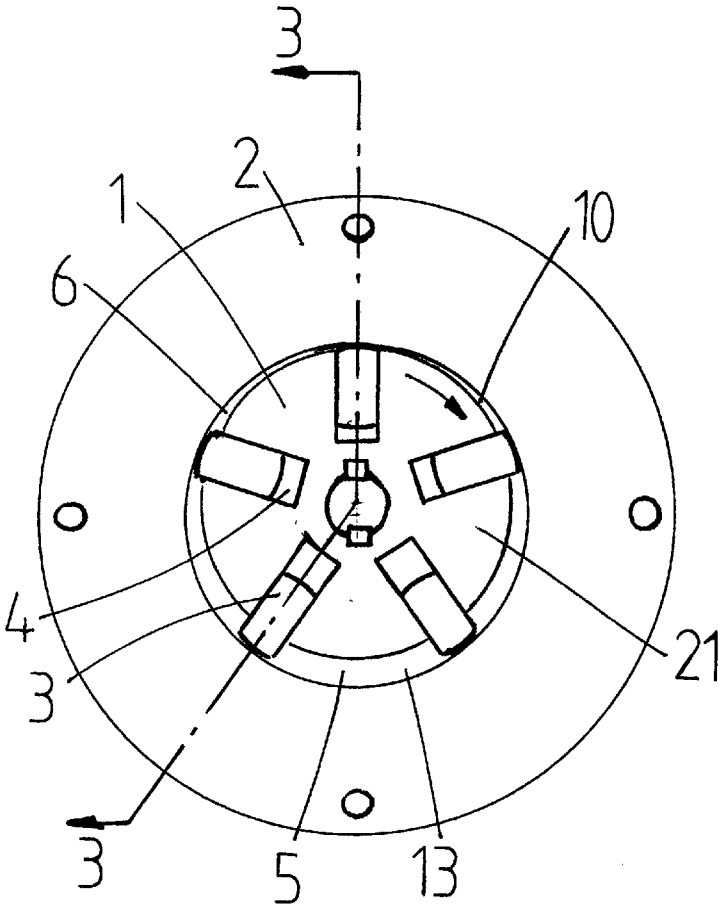
FIG. 2 is a section through the compressor. A section through the expander would be identical.
Figure 3:
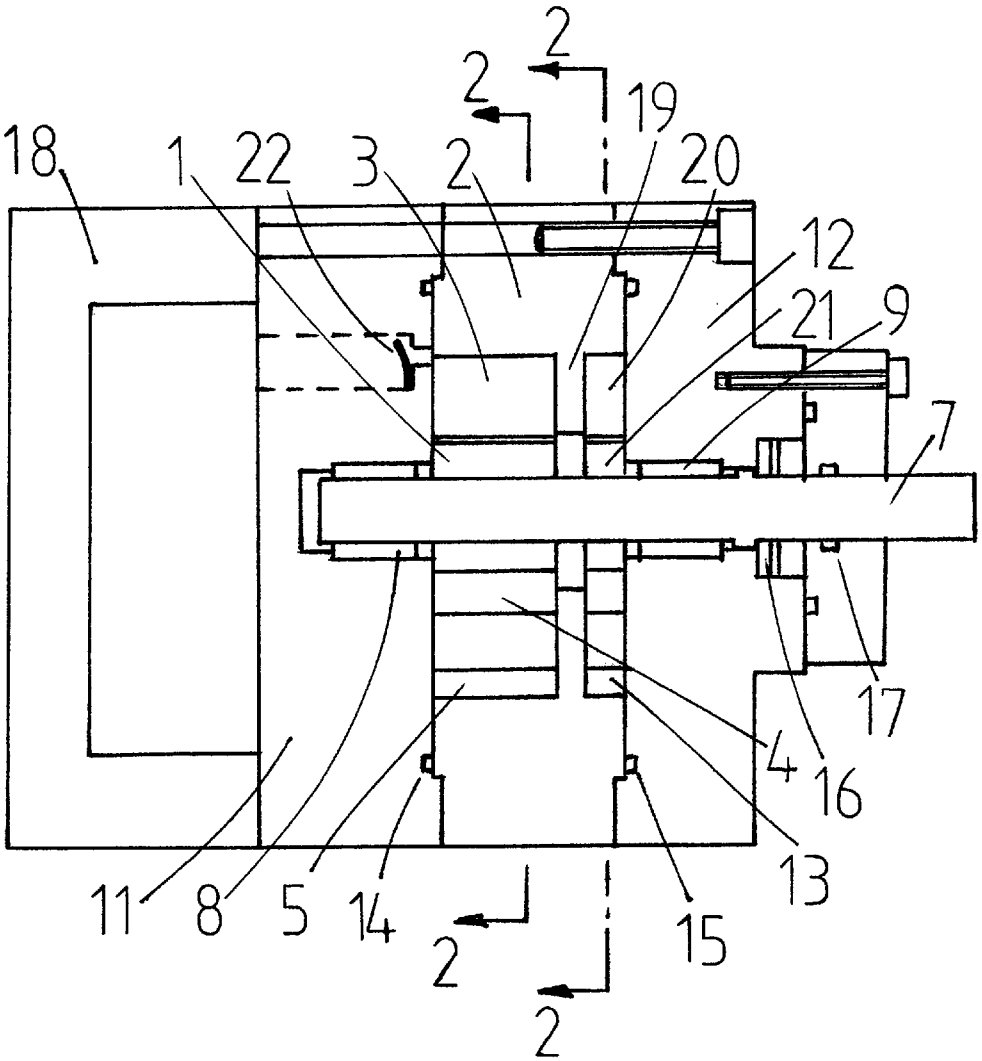
FIG. 3 is a side elevation of the compressor/expander assembly in section.

FIGS. 2 and 3 are cross sections through the compressor/expander assembly illustrating the principles of achieving the desired operating conditions in a simple efficient low cost assembly. From FIG. 2 it can be seen that the compressor section consists of a circular rotor 1 eccentrically located in a circular casing 2. Five vanes 3 can slide radially inwards and outwards in the slots 4 cut in the rotor. Compression occurs as the refrigerant vapor supplied to a large inlet volume 5 via generous inlet ports (not shown), is compressed during rotation into volume 6, where the high pressure vapor is discharged through a reed valve and generous porting (again not shown), and ideally situated in the end plate 11.

The rotor is mounted on an externally driven shaft 7 with keyways, or is integral with the shaft, and the shaft is supported in bearings 8,9 which are located in end plates 11, 12 in a conventional manner. The end plates and casing are bolted together and sealed by o rings 14, 15 using normal practice. Other conventional items shown are thrust bearings 16, shaft seal 17, an oil separator sump assembly 18, and reed valves 22. Leakage of refrigerant and friction are minimized by use of oil lubricant using well known techniques.

The central web 19 of the casing 2 provides the right hand boundary of the compressor section in FIG. 3, and the left hand boundary of the co expander section, which has vanes 20, and a separate rotor section 21 for ease of assembly. This central web 19 can be fabricated using low conductivity material to reduce thermal losses if necessary. If one considers FIG. 2 to be a section through the expander, then an inlet port (not shown) leads to inlet volume 10 which is expanded during rotation to volume 13 prior to discharge. Again the ports can be in the casing 2, but ideally in the end plate 12 so that the casing boundary surface is continuous.

I claim:

1. A refrigeration, air-conditioning or heat pump cycle comprising:

(a) compressing a vaporized fluid in a compressor driven by an external power source, with inlet conditions ideally approaching dry saturated, either slightly wet or slightly dry;

(b) condensing in a heat exchanger the fluid compressed in step (a) to ideally approach 0% quality;

(c) expanding the fluid condensed in step (b) to a pressure intermediate between the condenser and evaporator pressure using a flow control device, said intermediate pressure corresponding to the fluid inlet specific volume designed into the dynamic expander, discussed in (d) below;

(d) further expansion of all of the fluid expanded in (c) in a dynamic expander to recover fluid compression energy, and thereby reduce the net external shaft power supplied to the compressor in step (a), said expander being greatly simplified by being designed for a volume expansion ratio less than that corresponding to liquid inlet conditions;

(e) evaporation all of the fluid expanded in step (d) in a heat exchanger to ideally approach 100% quality;

(f) repeating the steps (a) to (e) above in a continuous cycle.

2. A rotating vane machine operating on a refrigeration, air-conditioning or heat pump cycle of claim 1, wherein the said compression step (a) occurs in a compressor section, and the said expansion step (d) occurs in an expander section, said compressor and said expander sections being located within a casing having a smooth internal profile, said casing being arranged between two end plates, said end plates supporting a common shaft in bearings, said shaft being driven by an external power source, and being connected to a compressor rotor and expander rotor separated at the working fluid regions by said casing, said rotors being eccentrically located within said casing such that an exceedingly close but non-touching relationship exists between said rotors and said casing at their minimum clearance which separates inlet from outlet, said rotor flat end faces being in a close fitting arrangement with said end plates, said rotors containing at least one slot containing a substantially rectangular close fitting vane, said vane having a profiled tip where in close proximity to said casing, said rotors having axial lengths compatible with typical fluid densities at said compressor inlet and said expander outlet conditions of said operating cycle.

3. The rotating vane machine of claim 2 wherein the said casing internal profile is circular.

4. The rotating vane machine of claim 2 wherein the said compressor and said expander contain a multiplicity of vanes, thus achieving desired compression and expansion ratios of said cycle.

5. The rotating vane machine of claim 2 wherein reed valves are employed at said compressor discharge and are mounted in said end plates or said casing.

6. The rotating vane machine of claim 2 wherein said vane tips are of circular profile, and said vane width such that smooth contact exists with said casing.

7. The rotating vane machine of claim 2 wherein said vanes are kept in close proximity to said casing by internal lubricant and refrigerant pressure, said lubricant being supplied to said compressor and said expander from a single oil sump.

8. The rotating vane machine of claim 2 wherein said compressor and said expander sections are separated by a low thermal conductivity casing web to minimize thermal losses.

9. A rotating vane machine operating on a refrigeration, air-conditioning or heat pump cycle, wherein the compression step occurs in a compressor section, and the expansion step occurs in an expander section following compatible partial expansion in a flow control device, said compressor and said expander sections being located within a casing having a smooth internal profile, said casing being arranged between two end plates, said end plates supporting a common shaft in bearings, said shaft being driven by an external power source, and being connected to a compressor rotor and expander rotor separated at the working fluid regions by said casing, said rotors being eccentrically located within said casing such that an exceedingly close but non-touching relationship exists between said rotors and said casing at their minimum clearance which separates inlet from outlet, said rotor flat end faces being in a close fitting arrangement with said end plates, said rotors containing at least one slot containing a substantially rectangular close fitting vane, said vane having a profiled tip where in close proximity to said casing, said rotors having axial lengths and number of vanes compatible with the fluid density requirements of said refrigeration, air-conditioning or heat pump cycle.

10. A refrigeration, air-conditioning or heat pump cycle compatible with the rotating vane machine of claim 9, and comprising:

(a) compressing a vaporized fluid in a compressor driven by an external power source, with inlet conditions ideally approaching dry saturated, either slightly wet or slightly dry;

(b) condensing in a heat exchanger the fluid compressed in step (a) to ideally approach 0% quality;

(c) expanding the fluid condensed in step (b) to a pressure intermediate between the condenser and evaporator pressure using a flow control device, said intermediate pressure corresponding to the fluid inlet specific volume designed into the dynamic expander discussed in section (d) below;

(d) further expansion of all of the fluid expanded in (c) in a dynamic expander to recover fluid compression energy, and thereby reduce the net external shaft power supplied to the compressor in step (a), said expander being greatly simplified by being designed for a volume expansion ratio less than that corresponding to liquid inlet conditions;

(e) evaporation all of the fluid expanded in step (d) in a heat exchanger to ideally approach 100% quality;

(f) repeating the steps (a) to (e) above in a continuous cycle.

11. The rotating vane machine of claim 9 wherein the said casing internal profile is circular.

* * * * *